US005725359A

United States Patent [19]

Dongo et al.

[11] Patent Number: 5,725,359

[45] Date of Patent: Mar. 10, 1998

[54] POOL PUMP CONTROLLER

[75] Inventors: Paul A. Dongo, Camarillo; David Garber, Ventura, both of Calif.

[73] Assignee: B&S Plastics, Inc., Oxnard, Calif.

[21] Appl. No.: 732,605

[22] Filed: Oct. 16, 1996

[51] Int. Cl.[6] ..... F04B 49/06

[52] U.S. Cl. ..... 417/44.9; 417/44.2; 417/38; 4/509; 200/73 R

[58] Field of Search ..... 417/38, 44.1, 44.2, 417/44.9; 4/509; 200/83 R, 83 F, 83 N, 83 P, 83 Q

[56] References Cited

U.S. PATENT DOCUMENTS

| | | | |
|---|---|---|---|
| 3,940,807 | 3/1976 | Baker et al. | 4/172 |
| 4,402,094 | 9/1983 | Sanders | 4/504 |
| 4,424,438 | 1/1984 | Antelman et al. | 219/362 |
| 4,505,643 | 3/1985 | Millis et al. | 417/12 |
| 4,602,391 | 7/1986 | Shepherd | 4/542 |
| 4,620,835 | 11/1986 | Bell | 417/17 |
| 4,658,449 | 4/1987 | Martin | 4/496 |
| 4,664,185 | 5/1987 | Barnard | 417/38 |
| 4,861,231 | 8/1989 | Howard | 417/38 |
| 4,867,654 | 9/1989 | Foster | 417/38 |
| 5,167,041 | 12/1992 | Burkitt, III | 4/541 |
| 5,347,664 | 9/1994 | Hamza et al. | 4/509 |
| 5,464,327 | 11/1995 | Horwitz | 417/43 |
| 5,499,406 | 3/1996 | Chalberg et al. | 4/541.2 |

FOREIGN PATENT DOCUMENTS 4010862 4/1991 Germany .

OTHER PUBLICATIONS

John S. Dempsey, *Basic Digital Electronics With MSI Applications*, Addison Wesley Publishing Co., 1979, pp. 156–161.

Paul Horowitz, Winfield Hill, *The Art of Electronics*, Cambridge University Press, New York, 1989 pp. 52–53 and 595–599.

*Primary Examiner*—Timothy Thorpe
*Assistant Examiner*—Xuan M. Thai
*Attorney, Agent, or Firm*—Koppel & Jacobs

[57] ABSTRACT

A pool pump controller includes a pneumatic pressure sensor having at least one port disposed to react to negative pressure within a pool's pump intake chamber. The sensor input port, which includes a check valve, is connected to a pump control switch through a pneumatic tube. The pump control switch combines aspects of a diaphragm switch and an opto-interrupter to provide high-reliability control of the pump motor in a watery environment.

17 Claims, 3 Drawing Sheets

POOL PUMP CONTROLLER

BACKGROUND OF THE INVENTION

1. Field of the Invention

The invention is related to pools such as swimming pools or therapeutic spas and, in particular, to safety devices for pools.

2. Description of the Related Art

Pool systems generally pump water from the pool through a drain located within the pool to a pump, through a filter and back into the main pool. In swimming pools the water is generally taken from the pool and returned at relatively low pressures. In spas the water is taken from the pool at a relatively low pressure, but returned to the pool through jets at relatively high pressure to provide the muscle-soothing therapeutic effect that is well known to spa users. Although in both swimming pools and spas the negative pressure across the pump intake, located within the pool, is relatively low, especially in comparison with the positive pressure developed at a spa's water jets, the total force across a pump intake faceplate can be substantial.

Because someone may block a small portion of the intake, with their hand for example, without experiencing a great deal of force, they may be led to believe that there is no danger involved in blocking a substantial portion of the intake. Unfortunately, serious injury, even death, may result from such action. Drownings can occur when hair or other body parts are sucked up against a pump's faceplate, holding the hapless victim under water. Serious injuries, such as anal evisceration (which may also prove fatal), can occur when an unsuspecting individual sits atop or backs up against a plump intake faceplate.

Recognizing these dangers, a number of safety devices for pools and spas have been developed. See the following United States Patents for example:

U.S. Pat. No. 4,424,438 Antelman et al.

U.S. Pat. No. 5,347,664 Hamza et al.

U.S. Pat. No. 5,167,041 Burkitt, III

U.S. Pat. No. 3,940,807 Baker, et al.

U.S. Pat. No. 4,402,094 Sanders

U.S. Pat. No. 4,602,391 Shepherd

U.S. Pat. No. 4,620,835 Bell

U.S. Pat. No. 4,658,449 Martin

U.S. Pat. No. 5,499,406 Chalberg et al.

Some supply air to the pump intake, causing the pump to cavitate and, hopefully, release the individual blocking the intake faceplate. Some employ a float sensor to turn the pump off whenever the negative pressure at the pump intake falls to a predetermined level. Others operate a pump shut off switch from the positive pressure (output) side of the pump.

Relying upon cavitation of the pump introduces a significant delay between the time an object is trapped at the pump intake and the time that the object is released. Furthermore, the pump may only release the trapped object momentarily, then re-trap it when the pump's prime is re-established. Employing a float to turn the pump off leaves the pump control system susceptible to malfunction due to the operation of wave action upon the float. That is, with the float bobbing about, the motor could be turned off and on repeatedly, never fully releasing the victim. And, since the negative pressure at the input side of a pump is only indirectly related to the pressure at the output side of the pump, relying upon measurement of the pump's output pressure to control the pump, at the very least, introduces response delays in a situation where time is of the essence.

SUMMARY OF THE INVENTION

The invention is directed to a pool pump controller that provides safe spa and swimming pool operation by turning off the pool's pump in response to the blockage of the pump's input faceplate. The new pump controller includes a new pressure sensor and a new diaphragm switch.

The invention comprises a diaphragm switch which combines a diaphragm with an opto-interrupter to respond to pressure changes which, in a pool pump intake application, indicate that a portion of the pump's intake faceplate has become blocked. The new switch permits reliable operation, reducing the probability of failures due to contact corrosion and shorting, in an aquatic environment. In a preferred embodiment the novel switch is attached to a pneumatic tube having at least one "sensing" port at its distal end, the combination forming a pressure sensor for operation with a pool pump controller. Each sensing port within the sensor includes a check valve which, when the pump is operating and its intake faceplate remains unblocked, prevents the flow of water into the tube.

As one component of a new pump controller, the pressure sensor has at least one port situated to react to negative pressure within the pump intake chamber. The sensor input port(s) communicate through a pneumatic tube with the novel switch, which is connected to turn the spa's pump off. In a preferred embodiment one central and two lateral sensor ports are situated near the front and sides, respectively, of the pump intake faceplate.

When operating, the pump's negative water pressure forces the check valves within each arm of the sensor tube shut. If a blockage occurs in the vicinity of a sensor port, the associated check valve opens and fluid (air and water) escapes from the sensor tube, thereby changing the pressure on the novel switch located at the other end of the tube. At some point, corresponding to sufficient faceplate blockage, the switch turns the pump off and the pump remains off until a manual startup switch is activated. In the preferred embodiment the manual startup switch must be depressed twice to restart the pump. This requirement provides further safety, in that a bystander cannot simply hit the switch in a panic and inadvertently turn the pump back on.

These and other features, aspects and advantages of the invention will be apparent to those skilled in the art from the following detailed description, taken together with the accompanying drawings.

DETAILED DESCRIPTION OF THE INVENTION

The new pool pump controller includes a new pressure sensor designed for operation within a pool pump's intake chamber. The sensor includes a pneumatic tube with a new diaphragm switch located at the end which is proximate to the controller's electronics. At its distal, "sensing", end the tube includes at least one aperture with a check valve positioned just inside the tube. This sensing end is positioned within the pump's input chamber near its intake faceplate and is oriented so that, during normal pumping action, the flow of water past the aperture closes the check valve. An interruption in the flow of water past the sensing end, caused for example, by someone's hair blocking the pump faceplate, opens the check valve thereby changing the pressure within the sensor's pneumatic tube. The change in pressure moves the new switch's diaphragm, shutting off power to the pool's pump.

In effect, the controller "latches" the pump power supply in the "off" position. In order to start the pump again a manual switch, preferably a pneumatic switch located near the pool, must be activated twice: first to "power down" the controller circuitry, then to "restart" it. Requiring that the manual switch be operated twice in this manner permits one to clear the obstruction from the pump's intake faceplate before the pump resumes pumping.

Figure 1B:
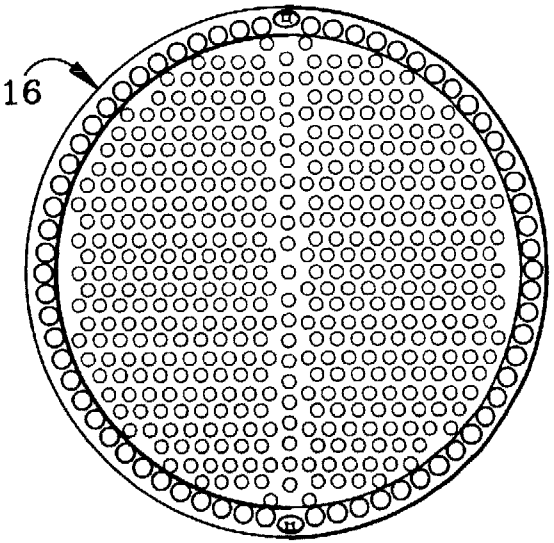
FIG. 1B is an elevation view of the pump intake faceplate in FIG. 1A.
Figure 1A:
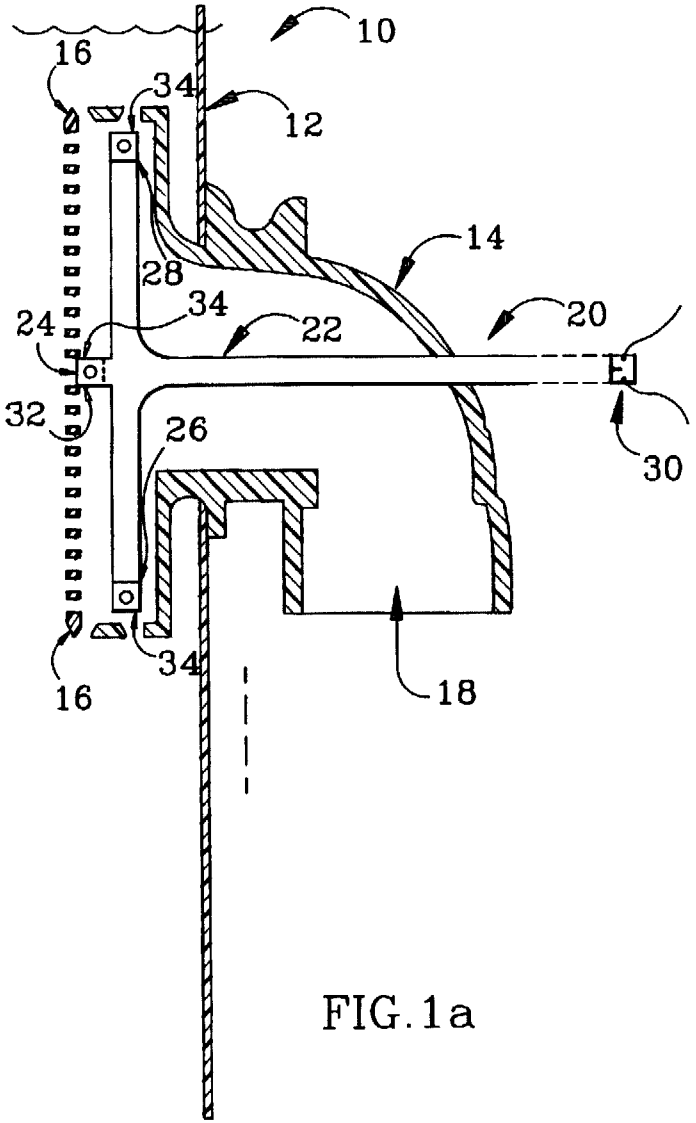
FIG. 1A is a sectional view of a pool system, including a new flow sensor that operates, along with electronic circuitry and other components, to produce a new pool pump controller.

The pool system 10 of FIG.1A includes a pool 12, which in this illustrative embodiment is a spa but may also be a swimming pool or a jetted bathtub. A pump intake 14 pierces the pool wall 12 to provide a pump with access to the pool's water. In operation, water is pumped from the pool 12 through an intake faceplate 16 into a chamber 18 within the pump intake and, from there, into the pump to be recirculated to the pool 12 through high-pressure jets. A new flow sensor 20 is disposed within the pump chamber 18 and includes a pneumatic tube 22, preferably formed of plastic and having, in the preferred embodiment, one central aperture 24 and two lateral apertures 26, 28 at its sensing end. A diaphragm switch 30 connectable to control power supplied to the pump motor is attached to the tube's other, proximal end. Check valves 34 that allow for a flow of water primarily only out of the sensor are positioned immediately within each aperture in the sensing end.

Check valves are known in the art and may comprise, for example, a floating ball having a diameter which permits fluid flow through the tube around the ball when the ball is unseated and a seating aperture which is substantially smaller than the tube aperture. Whenever the ball is forced against the seating aperture it blocks the flow of fluid at that point. Additionally, in the preferred embodiment the pump faceplate 16 includes a sensor tube support ring 32 which attaches to the tube 22 at its central aperture and supports the tube 22.

The sensor tube apertures 24, 26, 28 are situated so that during normal operation, i.e., whenever water is being pumped through the faceplate 16 into the pump intake chamber 18 without obstruction, the direction of water flow forces the check valves shut, e.g., forces the floating ball into the seating aperture, blocking water flow into the tube 22. Whenever a blockage occurs at the faceplate 16 near an aperture, due to the induction of hair for example, the flow patterns are disturbed and the check valve opens. When this occurs fluid within the tube 22 is pulled into the chamber 18, modifying the pressure on the diaphragm switch 30. In response, the diaphragm switch 30 cuts power to the pump motor. As will be explained in greater detail in relation to the description of FIG. 2, even after the obstruction is removed the pump cannot be started again until an independent manual control switch is reset. The broken line descending from the pump intake 14 indicates that additional intakes, with associated sensors 20 may be placed in the pool's wall 12 or bottom at a number of locations throughout the pool.

FIG. 1B illustrates a faceplate 16 having a substantially even distribution of openings across its face. In the preferred embodiment openings are also situated around the faceplate perimeter. Two or more radial sensor tube apertures, e.g.,26, 28, are positioned in proximity to the openings around the perimeter of the faceplate 16. As with the sensor aperture(s) in proximity to the front face of the faceplate, the radial sensor apertures are positioned such that during normal pumping action the check valves are forced shut by water entering the pump chamber 18.

Figure 2:
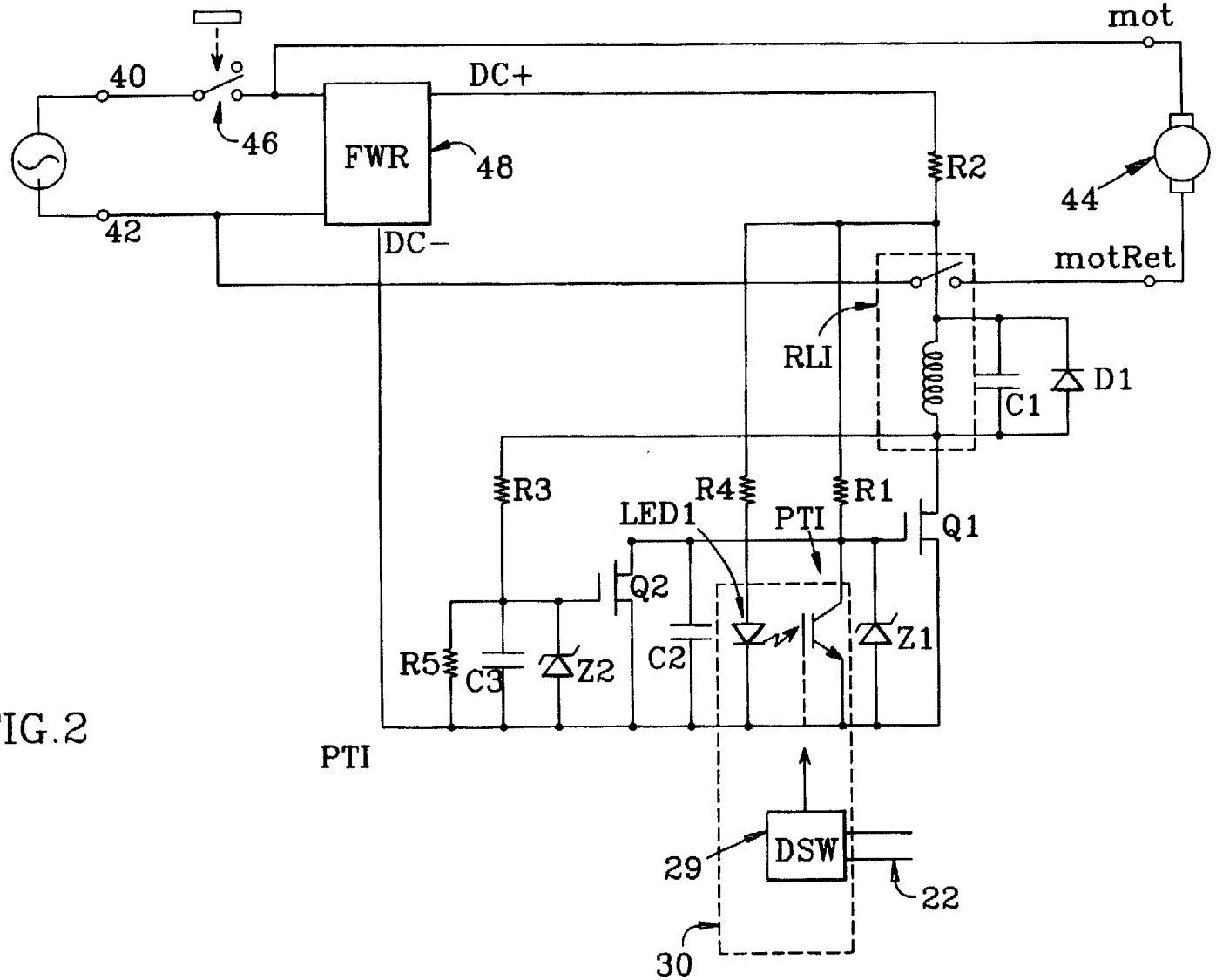
FIG. 2 is a schematic diagram of a preferred embodiment of the new pool pump controller's electronics system.

The control circuitry of FIG.2 includes alternating current input terminals 40 and 42 for receiving standard 110 or 220 Volt power for operation of a pump motor 44. Terminal 40 is connected, through a pneumatic switch 46, to one motor supply line MOT. The pneumatic switch is preferably a push-button switch, with the push-button located near the pool and connected through a pneumatic tube to the switch contacts, which are preferably located on a printed circuit board near the pump motor. By isolating the switch contacts and all other "hot" components from anyone who may have occasion to activate the switch 46, the pneumatic switch provides a margin of safety from shock hazard. The switch 46 is preferably a snap action switch which toggles between contacts whenever it is pushed, so that when it is pushed into either the closed or open position it will remain in that position until pushed again.

The other AC power terminal 42 is connectable through a relay RL1 to the other pump motor terminal MOTRET. During normal operation, both the relay RL1 and pneumatic switch 46 are closed and power is supplied to the pump motor 44. When the relay RL1 opens, control circuitry prevents the relay RL1 from closing again until power is withdrawn from the control circuit. This requires someone to depress the switch 46 once to break contact, then depress it again to return power to both the pump motor and to the control circuitry. This way, the relay won't repeatedly open and close, permitting a victim to only partially free himself from the pump intake faceplate before turning the pump on and trapping him again.

A full wave rectifier 48 converts incoming AC power to positive DC+ and negative DC− power sources for use by the control circuitry. A transistor Q1, an n-channel power field effect transistor (FET) in the preferred embodiment, has its drain and source connected to a power terminal of the relay RL1 and to the DC return DC−, respectively. The gate of transistor Q1 is connected to the cathode of a zener diode Z1 which is connected at its other terminal to DC−. Transistor Q1's gate is also connected through a voltage divider comprising resistors R1 and R2 to DC+. In the preferred embodiment the values of R2 and R1 are approximately 9 kΩ and 100 kΩ, respectively, zener diode Z1 is a 10–20 volt device, and transistor Q1 is rated to withstand 400 volts drain-to-source.

In normal operation, after power is applied to the control circuit by manually closing the pneumatic switch 46, the zener diode Z1 provides a semi-regulated voltage to the gate of transistor Q1 which is sufficient to drive the transistor Q1 into a "low on impedance" state, thereby pulling sufficient current through the solenoid of the relay RL1 to close RL1 and to thus provide a closed path for AC power to the pump motor 44. The voltage at the drain of Q1 is equal to DC− at this point. A capacitor C1 and a diode D1 in parallel with relay RL1 form a snubber circuit which protects the relay and associated circuitry, preventing arcing, whenever the relay is opened. Snubber circuits are known in the art. See Paul Horowitz, Winfield Hill, *The Art of Electronics*, Cambridge University Press, New York, 1989 pp 52–53 for a brief discussion of snubbers. A capacitor C2 (0.47 μF in the preferred embodiment) is connected between R1 and DC–, and operates with resistors R1 and R2 to yield a delay of approximately 50 milliseconds from the time power is applied until the relay RL1 closes.

The diaphragm switch 30 is connected to a pneumatic tube 22 and reacts to pressure changes within the tube. Specifically, in normal operation the switch obstructs the transmission of light through an opto-coupler comprising light emitting diode LED1 and photo-transistor PT1. Opto-couplers and their operation are known, see John A. Dempsey, *Basic Digital Electronics With MSI Applications*, Addison Wesley Publishing Co., 1979, pp 156–161 and Paul Horowitz, Winfield Hill, *The Art of Electronics*, Cambridge University Press, New York, 1989 pp 595–599 for a discussion of the operation of opto-couplers. When the pressure within the pneumatic tube 22 decreases, the diaphragm switch DSW removes the obstruction and photo-transistor PT1 turns on, shorting the gate of transistor Q1 to DC–, and thereby turning transistor Q1 off and opening the relay RL1. That is, the pump produces at least a partial vacuum within the sensor tube when the faceplate 16 is blocked by something in the spa an this pressure drop is sensed by the sensor and used to operate the diaphragm switch to turn the motor 44 off.

A latching circuit, including a n-channel FET Q2 connected at its source and drain to Q1's gate and the DC– terminal, respectively, a 10–20V zener diode Z2 connected to provide gate drive to the transistor Q2, and a capacitor C3 which, in series combination with a resistor R3, provides approximately a 100 millisecond delay, clamps the transistor Q1 off once it is turned off. That is, because the time constant of the R3/C3 combination is longer than that of the R1/C2 combination, when power is first applied to the controller by closing the switch 46, transistor Q1 turns on before the gate voltage of transistor Q2 reaches its threshold level. When transistor Q1 turns on it pulls the gate of transistor Q2 to the DC– terminal through resistor R3, preventing Q2 from turning on. However, when the photo-transistor PT1 turns transistor Q1 off, resistor R3 is connected, through the solenoid of relay RL1, to the DC+ terminal, causing Q2's gate voltage to rise to zener diode Z2's reverse breakdown voltage, 20 volts in the preferred embodiment. As a result transistor Q2 turns on, shorting transistor Q1's gate to DC– and preventing transistor Q1's gate voltage from rising, even if the blockage at the pump intake faceplate is cleared and the diaphragm switch 30 once again obstructs light from the LED1.

To turn the pump back on, power must be removed from the control circuit by depressing the switch 46. Then, when the switch 46 is depressed again, the relay RL1 will be closed as just described. A resistor R4, typically 100 kΩ, limits current through the LED1 and a resistor R5, also typically 100 kΩ, provides a current "bleed path" to drain charge from the capacitor C3.

Figure 3B:
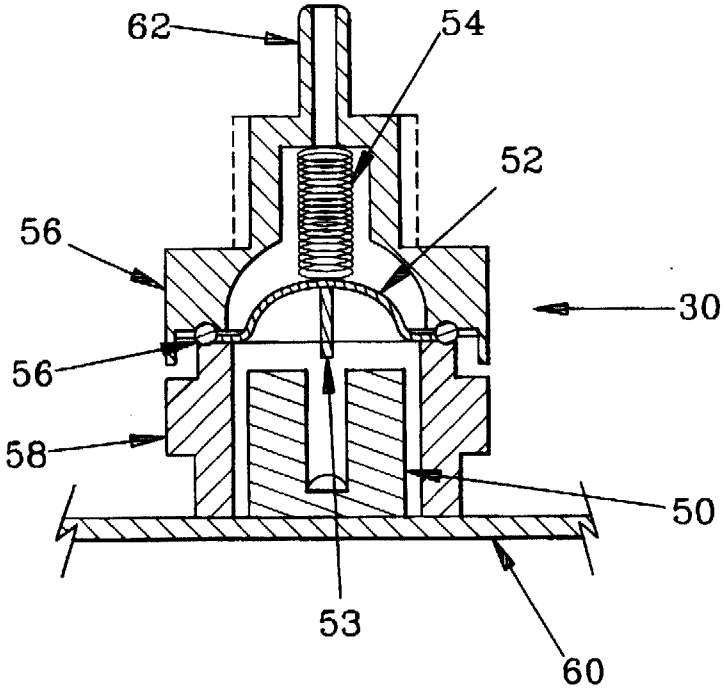
FIG. 3B is a sectional view of the new diaphragm switch in the open position.
Figure 3A:
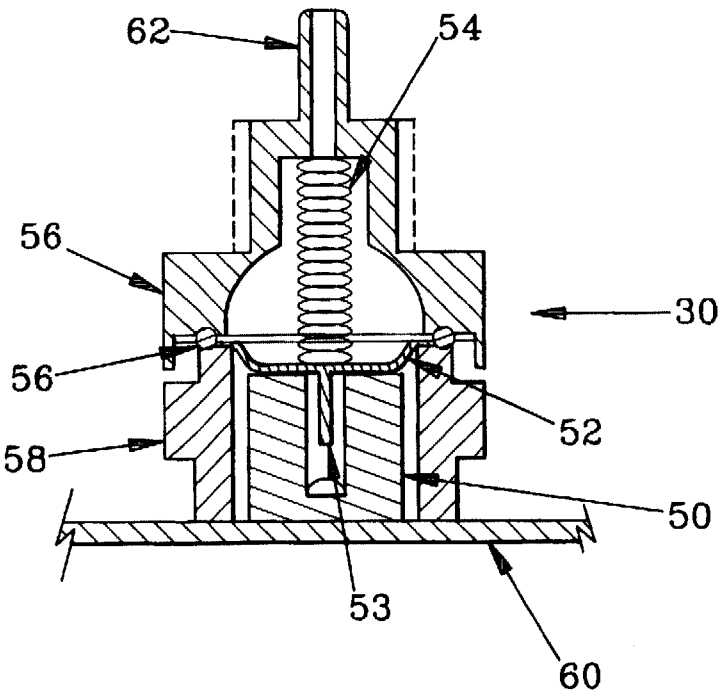
FIG. 3A is a sectional view of a new diaphragm in the "closed" position.

A preferred embodiment of the diaphragm switch 30 is illustrated in the sectional view of FIG. 3A. This view illustrates the switch in its "normally open" position, i.e., positioning an obstruction to block light from LED1 which would otherwise turn on mating photo-transistor PT1 within the opto-coupler 50. In its normal, inactive, position a projection 53 from a diaphragm 52 is held in place by a spring 54 to obstruct light flow between LED1 and PT1 of FIG. 2. For a more detailed illustration of the opto-coupler 50 see Paul Horowitz, Winfield Hill, *The Art of Electronics*, Cambridge University Press, New York, 1989 pp 598. In the preferred embodiment the switch housing 56 is composed of upper and lower sections hermetically sealed by an o-ring 58 and mounted to a printed circuit board 60 upon which the control circuitry of FIG. 2 is mounted. A nipple 62 is provided for the attachment of pneumatic tubing, such as the tube 22 of FIG. 1A.

When negative pressure is applied to the nipple 62 the diaphragm 52 moves in the direction of the nipple 62 and compresses the spring 54 and, as illustrated in the sectional view of FIG. 3B. With sufficient movement the projection 53 no longer obstructs the transmission of light between the transmitting and receiving elements of the opto-coupler 50. Since the tube 22 which attaches to the nipple 62 will probably contain a substantial amount of water vapor and some liquid water, conductive contacts placed on the nipple side of the diaphragm would be subject to corrosion and shorting. The new switch 30 converts a pressure signal into a light signal, then to an electrical signal, and in the process avoids the corrosion and shorting problems that conventional diaphragm switches would encounter in an aquatic environment.

The forgoing description of specific embodiments of the invention has been presented for the purposes of illustration and description. It is not intended to be exhaustive or to limit the invention to the precise forms disclosed, and many modifications and variations are possible in light of the above teachings. For example, although a cruciform distribution of sensor tube apertures is illustrated, any number of apertures may be distributed behind a pump intake faceplate. Furthermore, should multiple intake chambers be employed to supply intake water to the pump, the sensor tube could be distributed throughout the chambers to sense a blockage in any of the chambers and to turn the pump off accordingly. The embodiments were chosen and described to best explain the principles of the invention and its practical application, to thereby enable others skilled in the art to best utilize the invention. It is intended that the scope of the invention be limited only by the claims appended hereto.

We claim:

1. A pool pump controller, comprising:

a fluid pressure sensor comprising:

a diaphragm switch connectable to provide an electrical signal responsive to a change in fluid pressure, said switch comprising:

a housing with an interior chamber, a pressure port in said housing for transmitting a pressure signal to said chamber, a diaphragm mounted within said chamber to move in response to a pressure change from said pressure port, the diaphragm including a projecting obstruction member, and an opto-coupler connected to complete an optical transmission for one position of said diaphragm, with said obstruction member obstructing said optical transmission for a second diaphragm position, said opto-coupler producing an electrical signal indicative of whether its transmission is obstructed, and a pneumatic tube connected at one end to said diaphragm switch, the other end of the tube forming at least one input port having an opening and a check valve placed within the opening to block the flow of water into said pneumatic tube, a relay connected to respond to said electrical signal from said opto-coupler so that, when the controller is used to control a pump motor, the relay can be connected to close a current path to the motor.

2. The pool pump controller of claim 1, further comprising:

a manual switch connected in series with said relay.

3. The pool pump controller of claim 2, further comprising:

latching circuitry connected to latch said relay open whenever it is opened by said pressure sensor.

4. The pool pump controller of claim 3, wherein said latching circuitry releases said relay when power is removed from said circuitry.

5. A pool, comprising:

a pool for holding water, an electrical pump including a pump motor, at least one pump intake connected to draw water from said pool into said pump, a pool pump controller, comprising:

a fluid pressure sensor comprising:

a diaphragm switch connectable to provide an electrical signal responsive to a change in fluid pressure, said switch comprising:

a housing with an interior chamber, a pressure port in said housing for transmitting a pressure signal to said chamber, a diaphragm mounted within said chamber to move in response to a pressure change from said pressure port, the diaphragm including a projecting obstruction member, and an opto-coupler connected to complete an optical transmission for one position of said diaphragm, with said obstruction member obstructing said optical transmission for a second diaphragm position, said opto-coupler producing an electrical signal indicative of whether its transmission is obstructed, and a pneumatic tube connected at one end to said diaphragm switch, the other end of the tube forming at least one input port having an opening and a check valve placed within the opening to block the flow of water into said pneumatic tube, a relay connected to respond to said electrical signal from said opto-coupler so that, when the controller is used to control a pump motor, the relay can be connected to close a current path to the motor.

6. The pool of claim 5, wherein said pool includes a plurality of distributed pump intakes.

7. The pool of claim 6, wherein said pump controller further comprises:

a manual switch connected in series with said relay to close said pump current path.

8. The pool of claim 7, wherein said pump controller further comprises:

latching circuitry connected to latch said relay open whenever it is opened by said pressure sensor.

9. The pool of claim 8, wherein said latching circuitry releases said relay when power is removed from said circuitry.

10. A fluid pressure switch, comprising:

a housing with an interior chamber, a pressure port in said housing for transmitting a pressure signal to said chamber, a diaphragm mounted within said chamber to move in response to a pressure change from said pressure port, the diaphragm including an obstruction member which projects from the diaphragm, and an opto-coupler connected to complete an optical transmission for one position of said diaphragm, with said obstruction member obstructing said optical transmission for a second diaphragm position, said opto-coupler producing an electrical signal indicative of whether its transmission is obstructed.

11. A fluid pressure sensor, comprising:

a diaphragm switch connectable to provide an electrical signal in response to a change in fluid pressure, said switch comprising:

a housing with an interior chamber, a pressure port in said housing for transmitting a pressure signal to said chamber, a diaphragm mounted within said chamber to move in response to a pressure change from said pressure port, the diaphragm including an obstruction member which projects from the diaphragm, and an opto-coupler connected to complete an optical transmission for one position of said diaphragm, with said obstruction member obstructing said optical transmission for a second diaphragm position, said opto-coupler producing an electrical signal indicative of whether its transmission is obstructed, and a pneumatic tube connected at one end to said diaphragm switch, the other end of the tube forming at least one pressure sensor input port having an opening and a check valve placed within the opening to block the flow of water into said tube.

12. The sensor of claim 11, wherein said tube includes one central and two lateral sensor input ports arranged in cruciform.

13. The sensor of claim 11, wherein said tube includes a central tubular portion and an array of sensor input ports distributed on arms which radiate from said central portion.

14. A pool pump controller, comprising:

a pressure sensor including:

a tube with a sensing end forming at least one input port with each said port having an opening with a check valve placed to block the flow of water into said tube and to respond to a change in pressure at said opening, and a switch at the other end of said tube, said switch being responsive to said change in pressure by producing an electrical signal, and a relay connected to respond to said electrical signal from said switch so that, when the controller is used to control a pump motor, the relay can be connected to close a current path to the motor.

15. The pool pump controller of claim 14, further comprising:

a manual switch connected in series with said relay.

16. The pool pump controller of claim 15, further comprising:

latching circuitry connected to latch said relay open whenever it is opened by said pressure sensor.

17. The pool pump controller of claim 16, wherein said latching circuitry releases said relay when power is removed from said circuitry.

* * * * *